US010779705B2

(12) United States Patent
Ko et al.

(10) Patent No.: US 10,779,705 B2
(45) Date of Patent: Sep. 22, 2020

(54) RACK AND DISHWASHER INCLUDING THE SAME

(71) Applicant: LG ELECTRONICS INC., Seoul (KR)

(72) Inventors: Myungwon Ko, Seoul (KR); Kitae Kwon, Seoul (KR)

(73) Assignee: LG Electronics Inc., Seoul (KR)

( * ) Notice: Subject to any disclaimer, the term of this patent is extended or adjusted under 35 U.S.C. 154(b) by 167 days.

(21) Appl. No.: 15/746,433

(22) PCT Filed: Aug. 17, 2016

(86) PCT No.: PCT/KR2016/009012
§ 371 (c)(1),
(2) Date: Jan. 22, 2018

(87) PCT Pub. No.: WO2017/030355
PCT Pub. Date: Feb. 23, 2017

(65) Prior Publication Data

US 2018/0206700 A1 Jul. 26, 2018

(30) Foreign Application Priority Data

Aug. 18, 2015 (KR) ..... 10-2015-0116265

(51) Int. Cl.
*A47L 15/50* (2006.01)

(52) U.S. Cl.
CPC ..... *A47L 15/504* (2013.01); *A47L 15/502* (2013.01); *A47L 15/506* (2013.01); *A47L 15/507* (2013.01)

(58) Field of Classification Search
CPC .... A47L 15/502; A47L 15/506; A47L 15/504; A47L 15/507
See application file for complete search history.

(56) References Cited

U.S. PATENT DOCUMENTS

2008/0072937 A1* 3/2008 Choi ..... A47L 15/502 134/137
2012/0181242 A1* 7/2012 Jeong ..... A47L 15/502 211/70.7
2012/0292270 A1* 11/2012 Klump ..... A47L 15/50 211/41.8

FOREIGN PATENT DOCUMENTS

DE 102008062761 3/2010
DE 102011081774 A1 2/2013
EP 2789286 A1 10/2014

OTHER PUBLICATIONS

International Search Report and Written Opinion in International Application No. PCT/KR2016/009012, dated Dec. 6, 2016, 9 pages.
(Continued)

*Primary Examiner* — Benjamin L Osterhout
(74) *Attorney, Agent, or Firm* — Fish & Richarsdon P.C.

(57) ABSTRACT

A dishwasher (100) is disclosed. The dishwasher (100) includes a washing tub (130) for defining a washing space, a rack (200) provided in the washing tub (130) so as to be withdrawn from the washing tub (130) for receiving dishes, and a plurality of spraying units (132, 133, 134) for spraying wash water to the rack (200). The rack (200) includes an outer edge rib (210) for defining a space in which dishes are loaded, a variable space loading unit (240) upwardly and downwardly movably provided at the inside of the outer edge rib (210), and a lifting unit (250) provided at the outer edge rib (210) for upwardly and downwardly moving the variable space loading unit (240) to decrease and increase the loading space of the variable space loading unit (240).

14 Claims, 4 Drawing Sheets

(56) References Cited

OTHER PUBLICATIONS

Extended European Search Report in European Application No. 20161730.5, dated Jul. 17, 2020, 10 pages.

* cited by examiner

[Fig. 1]
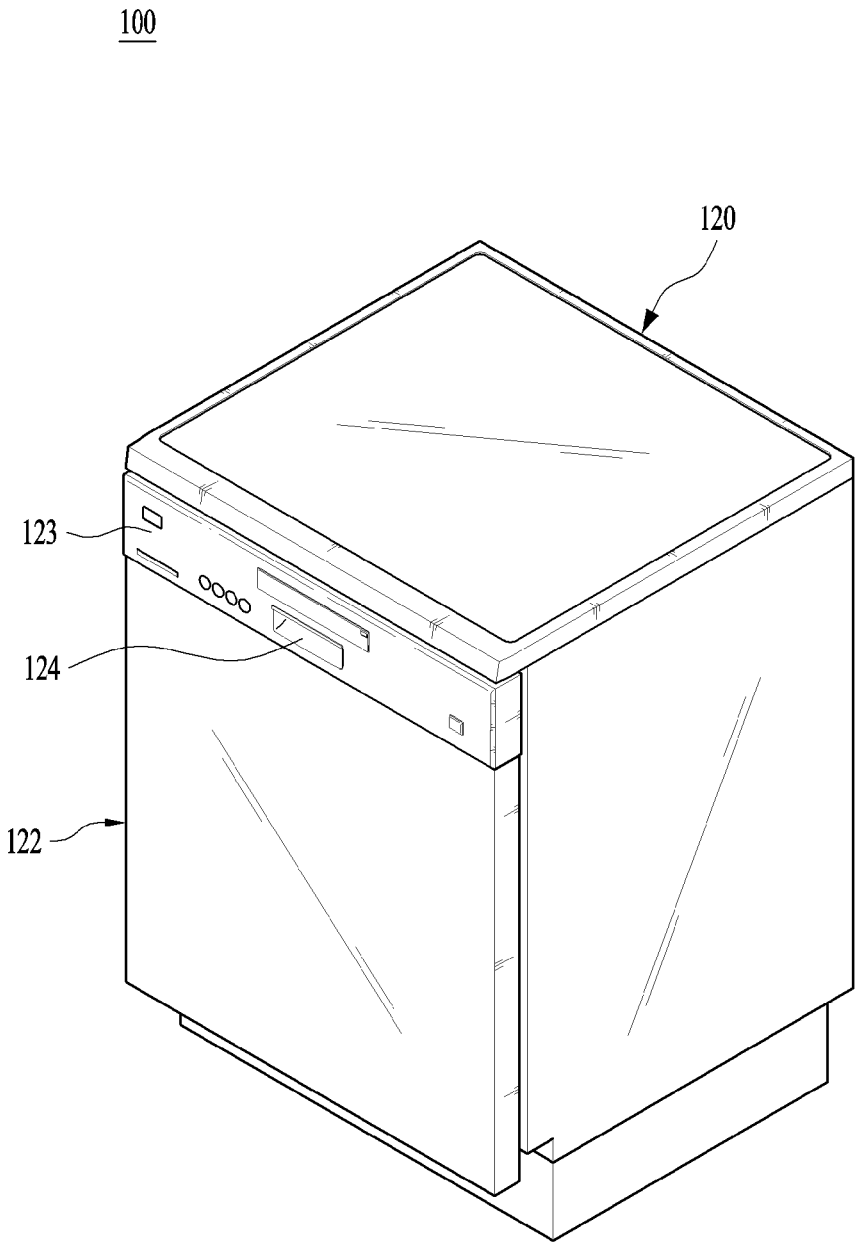

[Fig. 2]
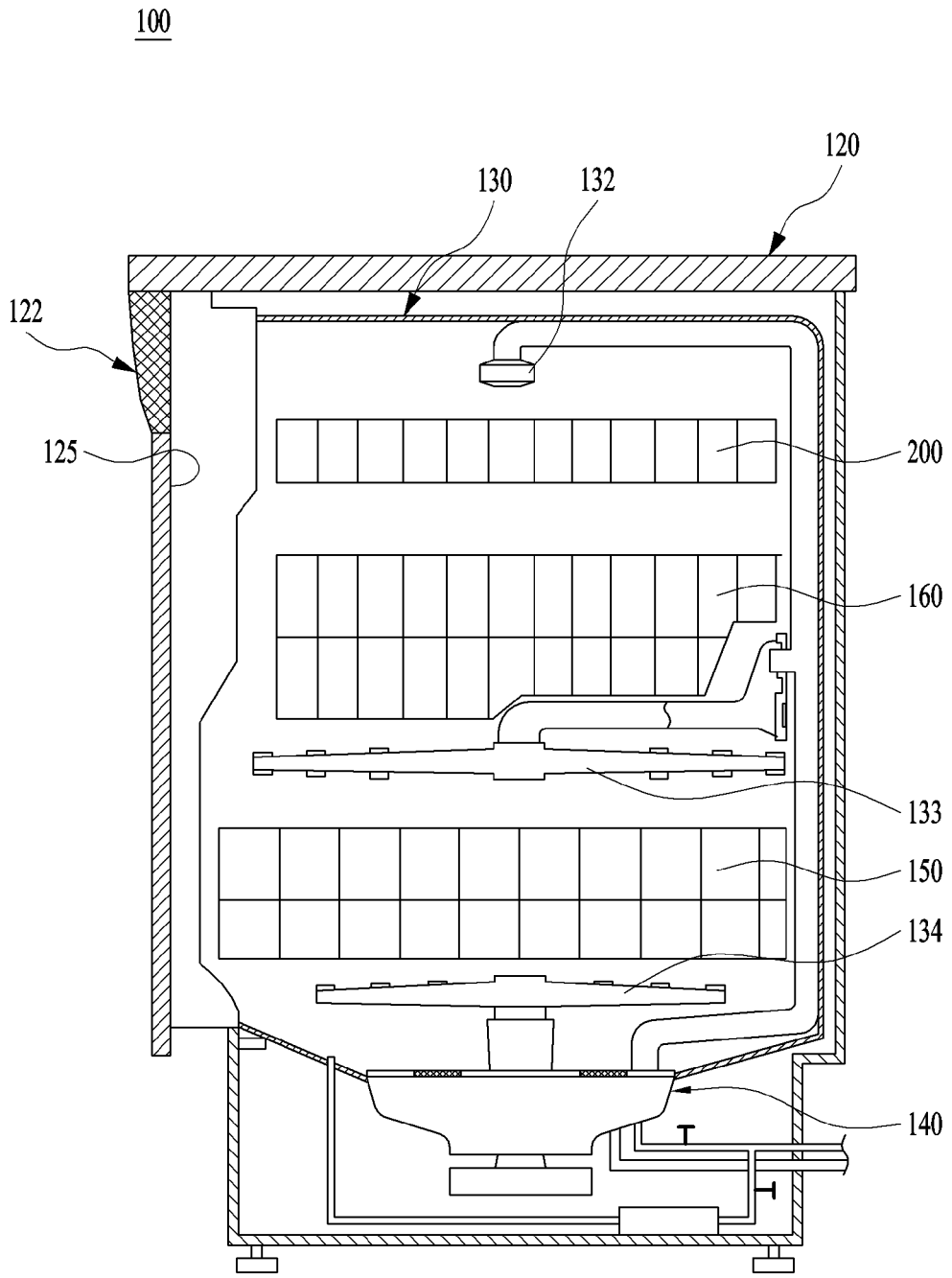

[Fig. 3]
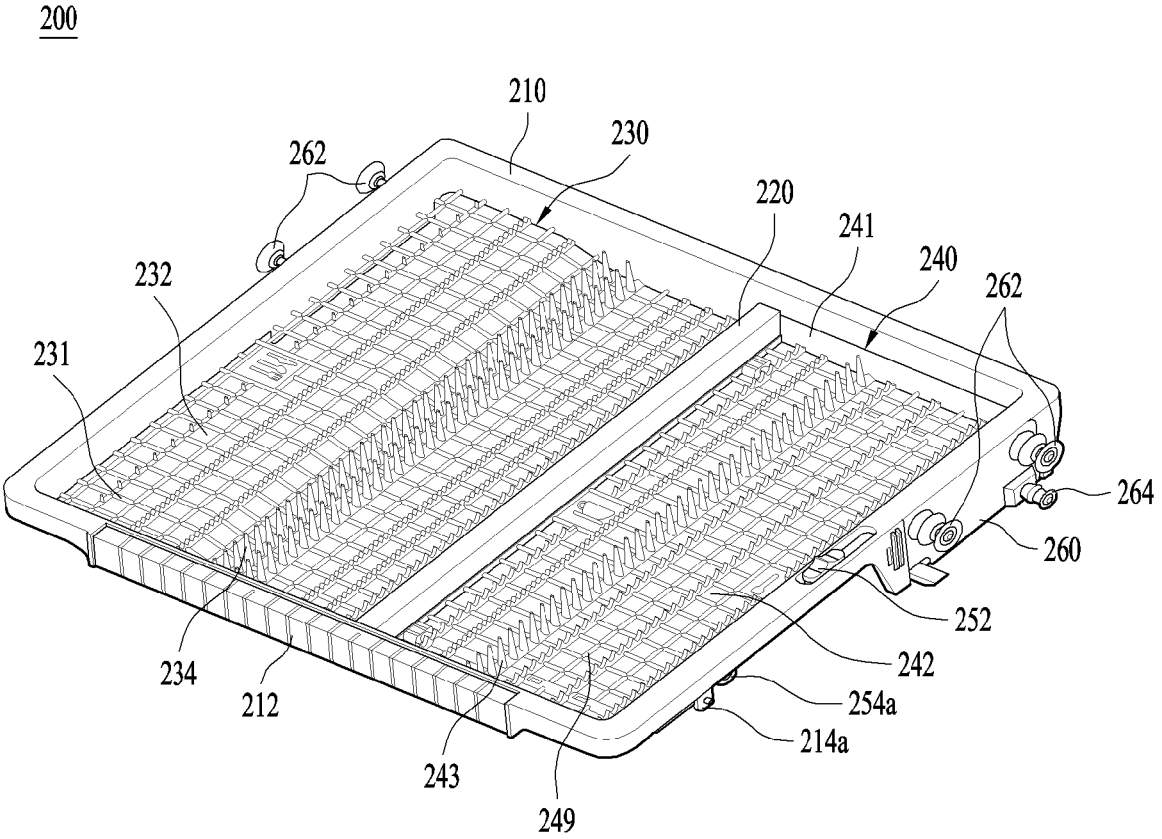
[Fig. 4]
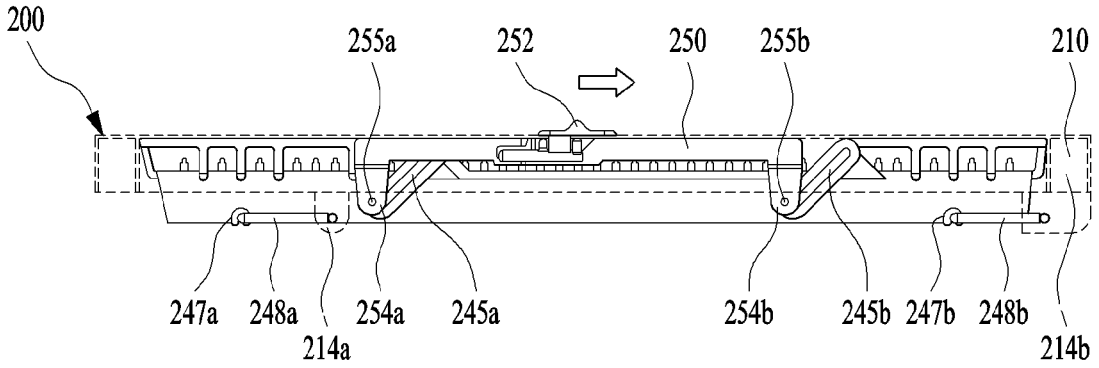

[Fig. 5]
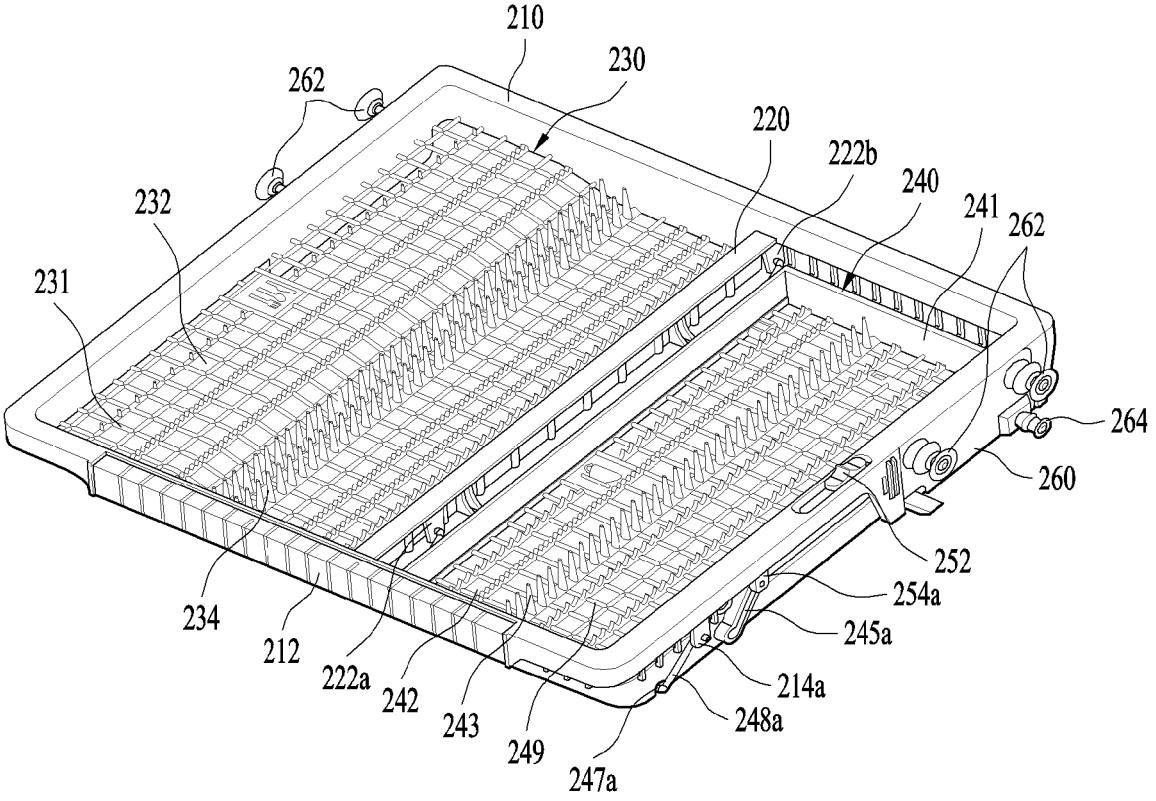
[Fig. 6]
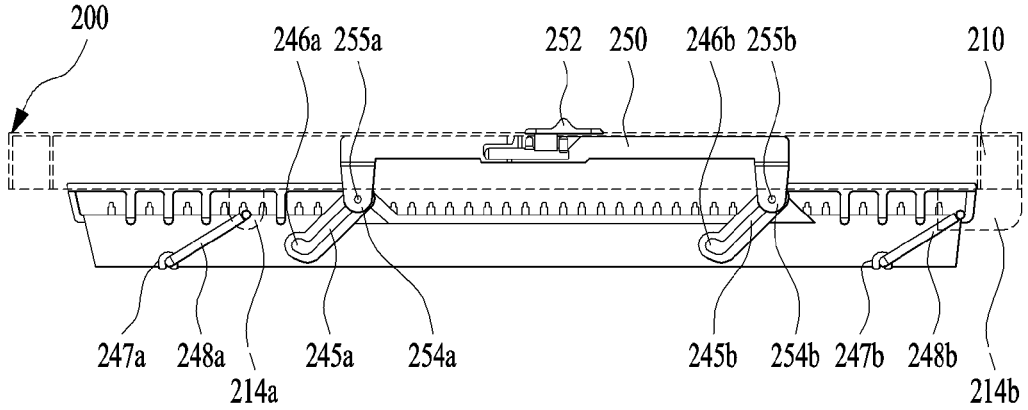

RACK AND DISHWASHER INCLUDING THE SAME

CROSS REFERENCE TO RELATED APPLICATIONS

This application is the National Phase of PCT International Application No. PCT/KR2016/009012, filed on Aug. 17, 2016, which claims priority under 35 U.S.C. 119(a) to Patent Application No. 10-2015-0116265, filed in the Republic of Korea on Aug. 18, 2015, which is hereby incorporated by reference herein in their entirety.

TECHNICAL FIELD

The present invention relates to a rack and a dishwasher including the same, and more particularly, to a rack configured to be easily introduced into and withdrawn from a dishwasher and to allow a user to easily handle dishes received in the rack and a dishwasher including the same.

BACKGROUND ART

Generally, a dishwasher is an apparatus that sprays high-pressure wash water to dishes received therein to wash the dishes and dries the washed dishes. Specifically, the dishwasher is operated such that high-pressure wash water is sprayed into a tub, in which dishes are received, and the sprayed wash water removes foreign matter, such as food waste, from the surfaces of the dishes.

The dishwasher is configured such that food waste contained in wash water is filtered by a filter for reuse of the used wash water and such that wash water containing detergent is supplied to smoothly separate food waste from dishes. In recent years, a dishwasher that increases the temperature of wash water or generates steam using a heater to improve washing efficiency has been widely used.

A conventional dishwasher includes a case defining the external appearance thereof, a washing tub provided in the case for defining a washing space in which dishes are washed, a door disposed in front of the washing tub for opening and closing the washing tub, a drive unit provided under the washing tub for supplying, collecting, circulating, and draining wash water, lower, upper, and top spraying units for spraying wash water supplied by the drive unit to the dishes, and lower, upper, and top racks separably provided between the lower, upper, and top spraying units, the lower, upper, and top racks being selectively loaded in the washing tub based on the kind or size of the dishes.

Each rack is provided at the lower part thereof with a plurality of moving rollers, which are guided along guide rails provided at the inside of the washing tub such that the rack is introduced into or withdrawn from the washing tub.

The lower rack is disposed adjacent to the lower spraying unit to receive relatively large-sized dishes. The upper rack is disposed adjacent to the upper spraying unit to receive relatively small-sized dishes. The top rack is disposed adjacent to the top spraying unit to receive eating utensils (e.g. spoons and knives) and cooking utensils (e.g. dippers and whisks) having smaller sizes than dishes.

In order to wash dishes using the dishwasher, a user opens the door of the dishwasher, withdraws one of the racks from the washing tub, places dishes in the withdrawn rack, pushes the withdrawn rack back into the washing tub of the dishwasher, and closes the door.

Subsequently, when the user operates the dishwasher, wash water is individually or simultaneously supplied to the lower, upper, and top spraying units according to the operation of the drive unit in order to wash the dishes loaded in the lower, upper, and top racks.

The top rack is provided to load and wash relatively small-sized dishes. Dishes that are received in the dishwasher have various sizes. Consequently, the size of some dishes may be too small to be loaded in the upper or lower rack, with the result that the dishes may waste space in the upper or lower rack. In addition, the size of some dishes may too large to be loaded in the top rack, with the result that it becomes impossible to load the dishes into the top tack.

That is, dishes may have various shapes and sizes, and the lower, upper, and top racks, which are provided in the washing tub, have specific sizes. As a result, some dishes may not efficiently use the spaces defined in the lower, upper, and top racks. Consequently, there is a necessity to design a rack that is capable of efficiently loading dishes having various shapes without wasting space defined in the rack.

DISCLOSURE OF INVENTION

Technical Problem

An object of the present invention devised to solve the problem lies in a rack configured such that a dish loading space is efficiently used depending on the shape or the size of dishes that are loaded in the dish loading space so as to be washed and a dishwasher including the same.

Solution to Problem

The object of the present invention can be achieved by providing a rack including an outer edge rib for defining a space in which dishes are loaded, a variable space loading unit upwardly and downwardly movably provided at the inside of the outer edge rib, and a lifting unit provided at the outer edge rib for upwardly and downwardly moving the variable space loading unit to decrease and increase the loading space of the variable space loading unit.

The variable space loading unit may be coupled to the outer edge rib in the state of being suspended by a pair of support links turnably provided at the outer edge rib.

The lifting unit may be provided with a slide protrusion movable in an interlocked state in response to the movement of the lifting unit, and the variable space loading unit may be provided with an inclined slot, into which the slide protrusion is inserted, the inclined slot having a predetermined angle of inclination.

The inclined slot may include a front inclined slot and a rear inclined slot arranged parallel to each other in the direction in which the lifting unit is moved, and the slide protrusion may include a front slide protrusion and a rear slide protrusion respectively inserted into the front inclined slot and the rear inclined slot.

The lifting unit may include a lifting lever protruding outward from the outer edge rib and an extension extending from the inside of the outer edge rib to the inclined slot, and the slide protrusion may be provided at one end of the extension so as to be inserted into the inclined slot.

The inclined slot may be provided at the lower end thereof with a holding hole, in which the slide protrusion is held.

The rack may further include a middle partition rib for partitioning the space defined by the outer edge rib into two parts.

The variable space loading unit may be provided in one of the two parts partitioned by the middle partition rib, and a fixed space loading unit, fixed to the outer edge rib and the middle partition rib, may be provided in the other of the two parts partitioned by the middle partition rib.

The variable space loading unit may be provided with a plurality of through holes through which wash water for washing the dishes passes and a plurality of support protrusions for preventing the movement of the dishes.

In another aspect of the present invention, provided herein is a dishwasher including a washing tub for defining a washing space, a rack provided in the washing tub so as to be withdrawn from the washing tub for receiving dishes, and a plurality of spraying units for spraying wash water to the rack, wherein the rack includes an outer edge rib for defining a space in which dishes are loaded, a variable space loading unit upwardly and downwardly movably provided at the inside of the outer edge rib, and a lifting unit provided at the outer edge rib for upwardly and downwardly moving the variable space loading unit to decrease and increase the loading space of the variable space loading unit.

The lifting unit may be provided with a slide protrusion movable in an interlocked state in response to the movement of the lifting unit, and the variable space loading unit may be provided with an inclined slot, into which the slide protrusion is inserted, the inclined slot having a predetermined angle of inclination.

The lifting unit may include a lifting lever protruding outward from the outer edge rib and an extension extending from the inside of the outer edge rib to the inclined slot, and the slide protrusion may be provided at one end of the extension so as to be inserted into the inclined slot.

Advantageous Effects of Invention

In the rack according to the present invention and the dishwasher including the same, it is possible to efficiently use a dish loading space depending on the shape or the size of dishes that are loaded in the dish loading space so as to be washed.

BRIEF DESCRIPTION OF DRAWINGS

The accompanying drawings, which are included to provide a further understanding of the invention, illustrate embodiments of the invention and together with the description serve to explain the principle of the invention.

In the drawings:

FIG. 1 is a perspective view showing a dishwasher according to the present invention;

FIG. 2 is a view simply showing the internal structure of the dishwasher according to the present invention;

FIG. 3 is a perspective view showing a first use state of a third rack of the dishwasher according to the present invention;

FIG. 4 is a side view showing the first use state of the third rack of the dishwasher according to the present invention;

FIG. 5 is a perspective view showing a second use state of the third rack of the dishwasher according to the present invention; and FIG. 6 is a side view showing the second use state of the third rack of the dishwasher according to the present invention.

BEST MODE FOR CARRYING OUT THE INVENTION

Reference will now be made in detail to the preferred embodiments of the present invention, examples of which are illustrated in the accompanying drawings.

In the following description of the present invention, names of constituent elements are defined in consideration of functions in the present invention. Therefore, the names of the constituent elements must not be construed as having meanings that restrict technical elements of the present invention. In addition, the names defined for the respective constituent elements may be substituted with other names in the art to which the present invention pertains.

Hereinafter, a dishwasher according to an embodiment of the present invention will be described in detail with reference to the accompanying drawings.

FIG. 1 is a perspective view showing a dishwasher according to the present invention, and FIG. 2 is a view simply showing the internal structure of the dishwasher according to the present invention.

As shown in FIGS. 1 and 2, a dishwasher 100 according to the present invention includes a case 120 defining the external appearance thereof, a washing tub 130 mounted in the case 120 for defining a washing space, in which dishes are washed, the washing tub 130 having a front open surface, a door 122 for opening and closing the open surface of the washing tub 130, a drive unit 140 provided under the washing tub 130 for supplying, collecting, circulating, and draining wash water, a plurality of racks 150, 160, and 200 separably provided in the washing tub 130 for receiving dishes, and a plurality of spraying units 132, 133, and 134 respectively provided adjacent to the racks 150, 160, and 200 for spraying wash water to wash dishes.

The washing tub 130, the driving unit 140, and the spraying units of the dishwasher 100 may have the same structures as or similar structures to those of a conventional dishwasher, and therefore a detailed description thereof will be omitted.

The racks 150, 160, and 200 are provided in the washing tub 130 so as to be withdrawn from the washing tub 130 through the open surface of the washing tub 130. The racks include a first rack 150 provided in the lower part of the washing tub 130 for receiving relatively large-sized dishes, a second rack 160 provided above the first rack 150 for receiving relatively small-sized dishes, and a third rack 200 provided in the upper part of the washing tub 130 for receiving cutlery and the like.

The spraying units 132, 133, and 134 are provided to spray wash water to the dishes received in the racks 150, 160, and 200, respectively. The spraying units include a lower spraying unit 134 provided in the lower part of the washing tub 130 for spraying wash water to the first rack 150, an upper spraying unit 133 provided between the first rack 150 and the second rack 160 for spraying wash water to the first and second racks 150 and 160, and a top spraying unit 132 provided in the upper part of the washing tub 130 for spraying wash water to the third rack 200 or the second rack 160.

Guide rails (not shown) for guiding the withdrawal and introduction of the first, second, and third racks 150, 160, and 200 are provided at opposite sidewalls of the washing tub 130. The guide rails may include fixed guide rails (not shown) for guiding the withdrawal and introduction of the first rack 150 and telescopic guide rails (not shown) for guiding the withdrawal and introduction of the second and third racks 160 and 200, the length of the telescopic guide rails being increased as the second and third racks 160 and 200 are withdrawn.

The door 122 is provided to open and close the front open surface of the washing tub 130. The door 122 is provided at the lower end of the open surface thereof with a hinge unit (not shown), about which the door 122 is hingedly rotated such that the door 122 is opened and closed.

The door 122 is provided at the outer surface thereof with a grip 124 for opening the door 122 and a control panel 123 for controlling the dishwasher 100. When the door 122 is closed, the inner surface of the door 122 defines one surface of the washing tub 130. When the door 122 is opened, the inner surface of the door 122 defines a location surface on which the first rack 150 is located. To this end, when the door 122 is opened, the location surface of the door 122 may horizontally extend from the guide rails for guiding the first rack 150.

Specifically, the present invention relates to the third rack 200 and the dishwasher 100 having the same. Consequently, the general construction of the dishwasher 100 and the first and second racks 150 and 160 will not be described.

Hereinafter the third rack 200, which is the gist of the present invention, will be described in detail with reference to the accompanying drawings.

FIG. 3 is a perspective view showing a first use state of a third rack of the dishwasher according to the present invention, and FIG. 4 is a side view showing the first use state of the third rack of the dishwasher according to the present invention.

As shown in FIGS. 3 and 4, the third rack 200 includes a fixed space loading unit 230 having a fixed loading space and a variable space loading unit 240 having a variable loading space. General-sized dishes may be loaded into the fixed space loading unit 230. Dishes having sizes that make them difficult to load into the fixed space loading unit 230 or dishes that waste the loading space in the first or second rack 150 or 160 when loaded in the first or second rack 150 or 160 may be selectively loaded into the variable space loading unit 240.

The third rack 200 further includes an outer edge rib 210 defining the outer edge of the fixed space loading unit 230 or the variable space loading unit 240, a middle partition rib 220 for partitioning the interior of the third rack 200 into the fixed space loading unit 230 and the variable space loading unit 240, a lifting unit 250 for upwardly and downwardly moving the variable space loading unit 240 to vary the loading space of the variable space loading unit 240, and moving roller units 260 supported by the telescopic guide rails such that the third rack 200 is withdrawn from the washing tub 130.

The outer edge rib 210 defines the outer edge of the third rack 200. The outer edge rib 210 is configured so as to correspond to the inner size of the washing tub 130. The outer edge rib 210 is formed to have a hollow box shape in order to improve the strength of the third rack 200. A grip 212 for introducing and withdrawing the third rack 200 is formed at the front of the outer edge rib 210. In addition, the outer edge rib 210 is provided at the lower part of one side thereof with a first front link turning unit 214*a* and a first rear link turning unit 214*b*, to which a front support link 248*a* and a rear support link 248*b*, a description of which will follow, are turnably coupled. The first front link turning unit 214*a* and the first rear link turning unit 214*b* will be described in detail when describing the variable space loading unit 240.

The moving roller units 260, supported by the telescopic guide rails provided at the washing tub 130, are provided at the rears of opposite sides of the outer edge rib 210. The moving roller units 260 include upper moving rollers 262 for supporting the upper surfaces of the telescopic guide rails and lower moving rollers 264 for supporting the lower surfaces of the telescopic guide rails.

The middle partition rib 220 partitions the interior of the third rack 200, defined by the outer edge rib 210, into the fixed space loading unit 230 and the variable space loading unit 240.

The middle partition rib 220 may partition the interior of the third rack 200, defined by the outer edge rib 210, into the fixed space loading unit 230 and the variable space loading unit 240 in the direction in which the third rack 200 is withdrawn or in the direction perpendicular to the direction in which the third rack 200 is withdrawn. In this embodiment, the middle partition rib 220 partitions the interior of the third rack 200, defined by the outer edge rib 210, into the fixed space loading unit 230 and the variable space loading unit 240 in the direction in which the third rack 200 is withdrawn.

The middle partition rib 220 is provided at the lower part thereof with a second front link turning unit 222*a* and a second rear link turning unit 222*b*, which are opposite the first front link turning unit 214*a* and the first rear link turning unit 214*b*, respectively. The variable space loading unit 240 is upwardly and downwardly movably supported by a front support link 248*a* turnably provided between the first front link turning unit 214*a* and the second front link turning unit 222*a* and a rear support link 248*b* turnably provided between the first rear link turning unit 214*b* and the second rear link turning unit 222*b*.

The fixed space loading unit 230 is provided in one of the two spaces partitioned by the middle partition rib 220. The fixed space loading unit 230 is provided at the lower surface thereof between the outer edge rib 210 and the middle partition rib 220 with a loading surface 231, on which dishes are located. The loading surface 231 is provided with a plurality of through holes 232 through which wash water for washing dishes passes or through which wash water that has been used to wash the dishes is drained. In addition, the loading surface 231 is provided with a plurality of support protrusions 234 disposed so as to be spaced apart from through holes 232 for preventing the movement of the dishes located on the loading surface 231 during washing of the dishes or when the third rack 200 is introduced and withdrawn.

The variable space loading unit 240 is provided in the other of the two spaces partitioned by the middle partition rib 220 such that the variable space loading unit 240 is upwardly and downwardly movable in the state of being separated from the outer edge rib 210 and the middle partition rib 220.

The variable space loading unit 240 includes a loading surface 249 on which dishes are loaded, a guide rib 241 protruding from the outer edge of the loading surface 249 for defining a dish loading space, and a front support link 248*a* and a rear support link 248*b* respectively turnably provided between the first front link turning unit 214*a* and the second front link turning unit 222*a* and between the first rear link turning unit 214*b* and the second rear link turning unit 222*b* for supporting the lower surface of the loading surface 249.

The loading surface 249 is provided at the lower surface thereof with a front link insertion slot 247*a*, into which the front support link 248*a* is inserted, and a rear link insertion slot 247*b*, into which the rear support link 248*b* is inserted. The variable space loading unit 240 is supported by the front support link 248*a* and the rear support link 248*b* so as to move in the manner of a pendulum. That is, the loading surface 249 ascends as the front support link 248*a* and the rear support link 248*b* are arranged horizontally, and the loading surface 249 descends as the front support link 248*a* and the rear support link 248*b* are arranged vertically. As a result, the loading space of the variable space loading unit 240 is variable.

The loading surface 249 is provided with a plurality of through holes 242 through which wash water for washing dishes passes or through which wash water that has been used to wash the dishes is drained. In addition, the loading surface 249 is provided with a plurality of support protrusions 243 disposed so as to be spaced apart from through holes 242 for preventing the movement of the dishes located on the loading surface 249 during washing of the dishes, when the third rack 200 is introduced and withdrawn, or when the variable space loading unit 240 is moved upward and downward.

The guide rib 241 of the variable space loading unit 240 is provided at one side thereof with a front inclined slot 245*a* and a rear inclined slot 245*b* having a predetermined angle of inclination. The front inclined slot 245*a* and the rear inclined slot 245*b* are arranged parallel to each other. The front inclined slot 245*a* and the rear inclined slot 245*b* are coupled to the lifting unit 250, a description of which will follow, such that the front inclined slot 245*a* and the rear inclined slot 245*b* slide along with the movement of the lifting unit 250 to upwardly and downwardly move the variable space loading unit 240. The front inclined slot 245*a* and the rear inclined slot 245*b* are respectively provided at the lower ends thereof with a front holding hole 246*a* and a rear holding hole 246*b*, through which the guide rib 241 is held by the lifting unit 250. The front inclined slot 245*a*, the rear inclined slot 245*b*, the front holding hole 246*a*, and the rear holding hole 246*b* will be described in detail when describing the lifting unit 250.

The lifting unit 250 upwardly or downwardly moves the variable space loading unit 240 of the third rack 200 relative to the outer edge rib 210 and the middle partition rib 220 in order to decrease or increase the loading space (specifically the loading depth) of the variable space loading unit 240.

The lifting unit 250 includes a lifting lever 252 for moving the lifting unit 250, a front extension 254*a* extending from the lifting lever 252 to the front inclined slot 245*a* of the variable space loading unit 240, a rear extension 254*b* extending from the lifting lever 252 to the rear inclined slot 245*b* of the variable space loading unit 240, a front slide protrusion 255*a* protruding from the front extension 254*a* so as to be inserted into the front inclined slot 245*a* and then slide, and a rear slide protrusion 255*b* protruding from the rear extension 254*b* so as to be inserted into the rear inclined slot 245*b* and then slide.

The lifting lever 252, the front and rear extensions 254*a* and 254*b*, and the front and rear slide protrusions 255*a* and 255*b* may be integrally formed by injection molding. Alternatively, the lifting lever 252, the front and rear extensions 254*a* and 254*b*, and the front and rear slide protrusions 255*a* and 255*b* may be separately formed so as to be separated from each other as needed.

The lifting unit 250 is disposed in the inner space of the outer edge rib 210, which is formed to increase the strength of the third rack 200. The lifting lever 252 is provided so as to extend through the outer edge rib 210 and to protrude above the outer edge rib 210.

The front extension 254*a* extends from the inner space of the outer edge rib 210 to the front inclined slot 245*a*. The front slide protrusion 255*a*, which is inserted into the front inclined slot 245*a*, is provided at one end of the front extension 254*a*.

The rear extension 254*b* extends from the inner space of the outer edge rib 210 to the rear inclined slot 245*b*. The rear slide protrusion 255*b*, which is inserted into the rear inclined slot 245*b*, is provided at one end of the rear extension 254*b*.

The front inclined slot 245*a* and the rear inclined slot 245*b*, which are formed at the variable space loading unit 240, are inclined upward in the direction in which the lifting unit 250 is moved.

The front holding hole 246*a* and the rear holding hole 246*b*, in which the front slide protrusion 255*a* and the rear slide protrusion 255*b* are respectively held, are respectively provided at the lower ends of the front inclined slot 245*a* and the rear inclined slot 245*b*.

When the lifting unit 250 is moved to the front side of the third rack 200, therefore, the front slide protrusion 255*a* and the rear slide protrusion 255*b* of the lifting unit 250 are respectively held in the front holding hole 246*a* and the rear holding hole 246*b* of the variable space loading unit 240 to support the variable space loading unit 240 in the state in which the variable space loading unit 240 is raised. When the lifting unit 250 is moved to the rear side of the third rack 200, the front slide protrusion 255*a* and the rear slide protrusion 255*b* are respectively separated from the front holding hole 246*a* and the rear holding hole 246*b* and then respectively move along the front inclined slot 245*a* and the rear inclined slot 245*b*. As a result, the front inclined slot 245*a* and the rear inclined slot 245*b* are pushed. Consequently, the variable space loading unit 240 moves downward relative to the lifting unit 250, the outer edge rib 210, and the middle partition rib 220, whereby the loading depth of the variable space loading unit 240 is increased. That is, the loading space of the variable space loading unit 240 is increased.

The outer edge rib 210, the middle partition rib 220, and fixed space loading unit 230 may be integrally formed by injection molding. The middle partition rib 220 and the fixed space loading unit 230 may be omitted as needed. That is, the entirety of the inner space of the outer edge rib 210, which defines the third rack 200, may constitute the variable space loading unit 240.

Hereinafter, the operation of the racks provided in the dishwasher according to the embodiment of the present invention will be described in detail with reference to the accompanying drawings. It should be noted that the elements mentioned below are to be understood with reference to the above description and drawings.

When describing the operation of the third rack according to the present invention, a first use state of the variable space loading unit, which is an initial state, will be described with reference to FIGS. 3 and 4, and a second use state of the variable space loading unit, which is a variable state, will be described with reference to FIGS. 5 and 6.

FIG. 5 is a perspective view showing a second use state of the third rack of the dishwasher according to the present invention, and FIG. 6 is a side view showing the second use state of the third rack of the dishwasher according to the present invention.

In order for the user to wash dishes using the dishwasher 100, the user opens the door 122 of the dishwasher 100, withdraws at least one of the first, second, and third racks 150, 160, and 200, loads dishes into the withdrawn rack, reintroduces the rack, in which the dishes are placed, into the washing tub 130 of the dishwasher 100, and closes the door 122.

Subsequently, when the user operates the dishwasher 100, wash water is individually or simultaneously supplied to the upper spraying unit 133, the lower spraying unit 134, and the top spraying unit in response to the operation of the drive unit 140, and the dishes loaded in the racks 150, 160, and

200 are washed, rinsed, and dried. The washing, rinsing, and drying of the dishes described above are very similar to the operation of a general dishwasher 100, and therefore a detailed description thereof will be omitted.

Before the dishwasher 100 is operated, it is necessary to place dishes in the respective racks. In addition, it is necessary to withdraw a specific one of the racks in order to place dishes in the specific rack.

The first rack 150 is moved while being guided along the fixed guide rails provided at the lower parts of the inner opposite surfaces of the washing tub 130. When withdrawn, the first rack 150 is located on the location surface of the door 122. Dishes are received in the first rack 150 in the state in which the first rack 150 is located on the location surface of the door 122.

The second rack 160 and the third rack 200 are moved while being guided along the telescopic guide rails provided at the inner opposite surfaces of the washing tub 130. Dishes are loaded into the second rack 160 and the third rack 200 in the state in which the second rack 160 and the third rack 200 are supported by the telescopic guide rails, the lengths of which have been increased.

Relatively small-sized dishes are received in the third rack 200. The dishes may be received in the variable space loading unit 240 provided at one side of the third rack 200 and the fixed space loading unit provided at the other side of the third rack 200.

In the first use state of the variable space loading unit 240, as shown in FIGS. 3 and 4, dishes are loaded into the variable space loading unit 240 in the state in which the variable space loading unit 240 is raised relative to the outer edge rib 210 or the middle partition rib 220.

At this time, the downward movement of the variable space loading unit 240 is restricted by the lifting unit 250. That is, when the lifting unit 250 is moved to the front side of the third rack 200, the front slide protrusion 255*a* provided at the front extension 254*a* of the lifting unit 250 and the rear slide protrusion 255*b* provided at the rear extension 254*b* of the lifting unit 250 are respectively held in the front holding hole 246*a* formed in the front inclined slot 245*a* of the variable space loading unit 240 and the rear holding hole 246*b* formed in the rear inclined slot 245*b* of the variable space loading unit 240. As a result, the position of the variable space loading unit 240 is restricted.

In the case in which the sizes of dishes to be loaded into the fixed space loading unit 230 and the raised variable space loading unit 240 are greater than the sizes of the loading spaces of the fixed space loading unit 230 and the raised variable space loading unit 240, the variable space loading unit 240 may be moved downward to increase the loading space of the variable space loading unit 240.

The loading space of the variable space loading unit 240 is increased as follows. As shown in FIGS. 5 and 6, the user moves the lifting lever 252 of the lifting unit 250 to the rear of the third rack 200. As a result, the front extension 254*a* and the rear extension 254*b* of the lifting unit 250 moves to the rear of the third rack 200 together with the lifting lever 252.

Consequently, the front slide protrusion 255*a* and the rear slide protrusion 255*b*, which are respectively formed at the front extension 254*a* and the rear extension 254*b*, are respectively separated from the front holding hole 246*a* and the rear holding hole 246*b* of the variable space loading unit 240 and then respectively slide along the front inclined slot 245*a* and the rear inclined slot 245*b*.

As a result, the supported state of the variable space loading unit 240 maintained by the front slide protrusion 255*a* and the rear slide protrusion 255*b* of the lifting unit 250 is released, and the front slide protrusion 255*a* and the rear slide protrusion 255*b* move downward along the front inclined slot 245*a* and the rear inclined slot 245*b* by gravity. Consequently, the loading space of the variable space loading unit 240 is increased.

The variable space loading unit 240 moving downward in response to the movement of the lifting unit 250 is suspended by the front support link 248*a* and the rear support link 248*b* while being moved in the manner of a pendulum by the front support link 248*a* and the rear support link 248*b*, which support the lower surface of the variable space loading unit 240. As a result, the loading space of the variable space loading unit 240 is increased.

MODE FOR THE INVENTION

Various embodiments have been described in the best mode for carrying out the invention.

INDUSTRIAL APPLICABILITY

The present invention provides a rack configured to be easily introduced into and withdrawn from a dishwasher and to allow a user to easily handle dishes received in the rack and a dishwasher including the same.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A rack comprising:

an outer edge rib that defines a space configured to receive dishes;

a variable space loading unit provided at an inside of the outer edge rib and configured to move upwardly and downwardly with respect to the outer edge rib;

a lifting unit provided at the outer edge rib and configured to move the variable space loading unit upwardly and downwardly to thereby decrease and increase a loading space of the variable space loading unit; and a pair of support links that are rotatably disposed at the outer edge rib and that are configured to rotatably support the variable space loading unit that is suspended from the outer edge rib.

2. The rack according to claim 1, wherein the lifting unit is provided with a slide protrusion movable in an interlocked state in response to movement of the lifting unit, and the variable space loading unit is provided with an inclined slot, into which the slide protrusion is inserted, the inclined slot having a predetermined angle of inclination.

3. The rack according to claim 2, wherein the inclined slot comprises a front inclined slot and a rear inclined slot arranged parallel to each other in a direction in which the lifting unit is moved, and the slide protrusion comprises a front slide protrusion and a rear slide protrusion respectively inserted into the front inclined slot and the rear inclined slot.

4. The rack according to claim 2, wherein the lifting unit comprises a lifting lever protruding outward from the outer edge rib and an extension extending from the inside of the outer edge rib to the inclined slot, and the slide protrusion is provided at one end of the extension so as to be inserted into the inclined slot.

5. The rack according to claim 2, wherein the inclined slot is provided at a lower end thereof with a holding hole, in which the slide protrusion is held.

6. The rack according to claim 1, further comprising a middle partition rib for partitioning the space defined by the outer edge rib into two parts.

7. The rack according to claim 6, wherein the variable space loading unit is provided in one of the two parts partitioned by the middle partition rib, and a fixed space loading unit, fixed to the outer edge rib and the middle partition rib, is provided in the other of the two parts partitioned by the middle partition rib.

8. The rack according to claim 1, wherein the variable space loading unit is provided with a plurality of through holes through which wash water for washing the dishes passes and a plurality of support protrusions for preventing movement of the dishes.

9. The rack according to claim 1, wherein the variable space loading unit defines a pair of link insertion slots that are configured to receive ends of the pair of support links, and wherein each of the pair of support links is configured to rotate about one of the pair of link insertion slots.

10. A dishwasher comprising:

a washing tub that defines a washing space;

a rack disposed in the washing tub and configured to be withdrawn from the washing tub to receive dishes; and a plurality of spraying units configured to spray wash water to the rack, wherein the rack comprises:

an outer edge rib that defines a space configured to receive the dishes, a variable space loading unit disposed at an inside of the outer edge rib and configured to move upwardly and downwardly with respect to the outer edge rib, a lifting unit disposed at the outer edge rib and configured to move the variable space loading unit upwardly and downwardly to thereby decrease and increase a loading space of the variable space loading unit, and a pair of support links that are rotatably disposed at the outer edge rib and that are configured to rotatably support the variable space loading unit that is suspended from the outer edge rib.

11. The dishwasher according to claim 10, wherein the lifting unit is provided with a slide protrusion movable in an interlocked state in response to movement of the lifting unit, and the variable space loading unit is provided with an inclined slot, into which the slide protrusion is inserted, the inclined slot having a predetermined angle of inclination.

12. The dishwasher according to claim 11, wherein the lifting unit comprises a lifting lever protruding outward from the outer edge rib and an extension extending from the inside of the outer edge rib to the inclined slot, and the slide protrusion is provided at one end of the extension so as to be inserted into the inclined slot.

13. The dishwasher according to claim 12, wherein the inclined slot comprises a front inclined slot and a rear inclined slot arranged parallel to each other in a direction in which the lifting unit is moved, and the slide protrusion comprises a front slide protrusion and a rear slide protrusion respectively inserted into the front inclined slot and the rear inclined slot.

14. The dishwasher according to claim 13, wherein the inclined slot is provided at a lower end thereof with a holding hole, in which the slide protrusion is held.

* * * * *